US006062979A

United States Patent [19]

Inoue

[11] Patent Number: 6,062,979

[45] Date of Patent: May 16, 2000

[54] VIDEO CARD GAME MACHINE

[75] Inventor: Haruo Inoue, Tokyo, Japan

[73] Assignee: Eagle Co., Ltd., Tokyo, Japan

[21] Appl. No.: 08/777,588

[22] Filed: Dec. 31, 1996

[30] Foreign Application Priority Data

Jul. 2, 1996 [JP] Japan ..... 8-192915

[51] Int. Cl.[7] ..... A63F 9/22; G06F 15/00

[52] U.S. Cl. ..... 463/12; 463/30; 273/292

[58] Field of Search ..... 463/1, 12–13, 463/16, 25, 29, 30, 31, 35, 36; 364/410.1, 411.1, 412.1; 273/292, 293, 138.1, 138.2, 139; 434/118; 706/927, 11

[56] References Cited

U.S. PATENT DOCUMENTS

| | | | |
|---|---|---|---|
| 4,569,526 | 2/1986 | Hamilton | 273/237 |
| 4,760,527 | 7/1988 | Sidley | 463/13 |
| 4,856,787 | 8/1989 | Itkis | 273/237 |
| 5,033,744 | 7/1991 | Bridgeman et al. | 463/13 |
| 5,103,498 | 4/1992 | Lanier et al. | 434/118 |
| 5,221,083 | 6/1993 | Dote | 463/34 |
| 5,255,915 | 10/1993 | Miller | 463/13 |
| 5,362,064 | 11/1994 | Lufink et al. | 273/292 |
| 5,476,259 | 12/1995 | Weingardt | 463/28 |
| 5,630,753 | 5/1997 | Fuchs | 463/13 |

OTHER PUBLICATIONS

Scarnes Encyclopedia of Games, by John Scarne, copyright 1973, pp. 290–302.

*Primary Examiner*—Mark A. Sager
*Attorney, Agent, or Firm*—Young & Thompson

[57] ABSTRACT

A video card game machine has a central processing unit for simulating a card game in accordance with a game control program and a display for displaying a plurality of playing cards. In a baccarat game, two playing cards are distributed to a banker and to a player. One of the four playing cards becomes a judgment card which is turned face down. Prior to displaying playing cards on the display, a game player predicts a winning competitor or a tie game and a bet state is entered from an operation panel to the central processing unit. The number of the judgment card leading to a hit of the prediction made by the game player, is displayed on the display and surrounded by a frame. After the win/tie conditions are displayed, the judgment card is faced. If it is possible to draw the third playing card, the frame is continuously displayed, whereas if the next playing card cannot be drawn and the game is terminated, the frame is flashed.

4 Claims, 10 Drawing Sheets

VIDEO CARD GAME MACHINE

BACKGROUND OF THE INVENTION

1. Field of the Invention

The present invention relates to a video card game machine having a display on which simulated card games are displayed. More particularly, the present invention relates to a video card game machine suitable for a baccarat game using playing cards.

2. Description of the Related Art

A video card game machine is known, which uses both a computer and a display to play a card game. This video card game machine uses cards to play baccarat, poker, blackjack, and other games.

Baccarat is a card game played by a banker and a player. A game participant (hereinafter called a player) predicts which one of two competitors will win or a tie game. The player places money at the post of a competitor predicted to win or at a tie post. A competitor having a sum of the numbers of two or three playing cards nearer to "9" is the winner. If both the competitors have the same number, the game is a tie. The jack "J", the queen "Q", the king "K", and the ten "10" are counted as "10", and the ace "A" is counted as "1". In this specification, these "J", "Q", "K", and "A" cards are used as numbers. If the sum of the numbers of a plurality of playing cards has two digits, the number of the second digit is used. For example, if the sum is "24", the number "4" is used.

A player who has bet on a winning competitor is paid, as a dividend, with coins twice the bet money. If one banker is bet, a 5% commission is deducted in advance. If the game is a tie, the bet is refunded. However, if the game player bets the tie, coins nine times the bet money are paid as a dividend.

Basically, baccarat determines its win, loss or tie by using four playing cards, two playing cards being distributed to each competitor. In some cases, the third card is distributed to one or both of the two competitors. Whether this third card is drawn or not depends on various strict card rules. Therefore, it is difficult for a novice to determine whether the game has ended or continues. It is also difficult for a novice to know what number of the last card will make the competitor who has been bet by the player a winner or a tie game.

SUMMARY OF THE INVENTION

It is a principal object of the present invention to provide a video card game machine capable of playing a card game easily even by a beginner by displaying the game result conditions during a play.

It is another object of the present invention to provide a video card game machine capable of increasing thrills of a card game by giving a game player expectations and anxieties as to whether an anticipated card will be drawn.

It is still another object of the present invention to provide a video card game machine capable of displaying a termination of a current card game or capable of continuing the same.

It is a further object of the present invention to provide a video card game machine capable of continuing a card game or terminating it by changing a display style of the game conditions.

It is a final object of the present invention to provide a video card game machine capable of helping a novice easily understand baccarat card rules.

In order to achieve the above and other objects, the video card game machine has a display for displaying a simulated card game. On this display, the game conditions are displayed during playing the card game. The game conditions displayed include the conditions of a win, a tie, a win or tie, and a loss. On this display, either a termination of a card game or a capability of continuing the same is also displayed.

According to a preferred embodiment of the present invention, the video card game machine simulates a baccarat card game. The screen of the display is provided with at least a banker card display area, a player card display area, and a win/tie display area. Two or three playing cards distributed to the banker are displayed in the banker card display area. Two or three playing cards distributed to the player are displayed in the player card display area.

Four playing cards are distributed alternatively for the banker and player, two playing cards therefore being distributed to each competitor. At least one of the four cards is distributed in a pre-down state, and it is turned over to expose the face thereof. In accordance with the number of the exposed playing card, the game results (win, tie, and loss) and the card game progress state (termination or continuation are determined. The playing card in the exposed state is called a judgment card in this specification.

In a baccarat game, the game cannot be judged in some cases from the four playing cards distributed. In such cases, the card game continues and a third playing card is distributed to one of, or both, the two competitors. If the third playing card is distributed to only one of the competitors, this third playing card then becomes the judgment card. If the third playing card is distributed to both the competitors, one of the third playing cards becomes the judgment card. In the above manner, if the card game continues, two judgment cards are distributed during one card game.

In the win/tie condition display area, a train of playing cards is displayed. Particular numbers in the train are displayed so that win/tie conditions are displayed as the game conditions. As described previously, depending upon the number of the judgment card, there is a capability of drawing the third playing card. In this case, the number necessary for the competitor whom the game player bet on to become a winner, is surrounded by, e.g., a red frame. The number necessary for a tie is surrounded by, e.g., a blue frame. With these frames, the win/tie conditions and a capability of continuing the card game are displayed. If the game player bets on a tie game, only the tie conditions are displayed as the game result conditions.

There is a case wherein the card game is terminated irrespective of what number the judgment card has when it is faced. For example, this case occurs when the third playing card is distributed to the banker as the judgment card. In this case, the win/tie conditions and a termination of the card game are displayed by red and blue flashing frames. Obviously if the game player bets on the tie game, only the tie conditions are displayed as the game conditions.

According to the present invention, since the game conditions are displayed, even a novice with little knowledge of card rules can enjoy playing a game. Since the game hit conditions are known, the game player can look forward to facing the judgment card with expectations and anxieties as to whether the hit conditions are satisfied. This increases the thrill of the card game. It is also easy to know whether the card game terminates or there is a possibility to continue the same. Furthermore, a beginner can understand card rules faster by referring to a display of the game conditions and game progress state (termination or ability to continue a card game). One of the game conditions and the game progress state is displayed differently from the display style of the other, so that the screen of a display can be used efficiently.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENTS

Playing cards usable by this invention include various playing cards in Europe, America, Japan, and other countries. Games using playing cards are, for example, baccarat, blackjack and poker. Although baccarat is used by way of example in the following description, it is to be noted that the invention is applicable to various types of playing card games.

Figure 1:
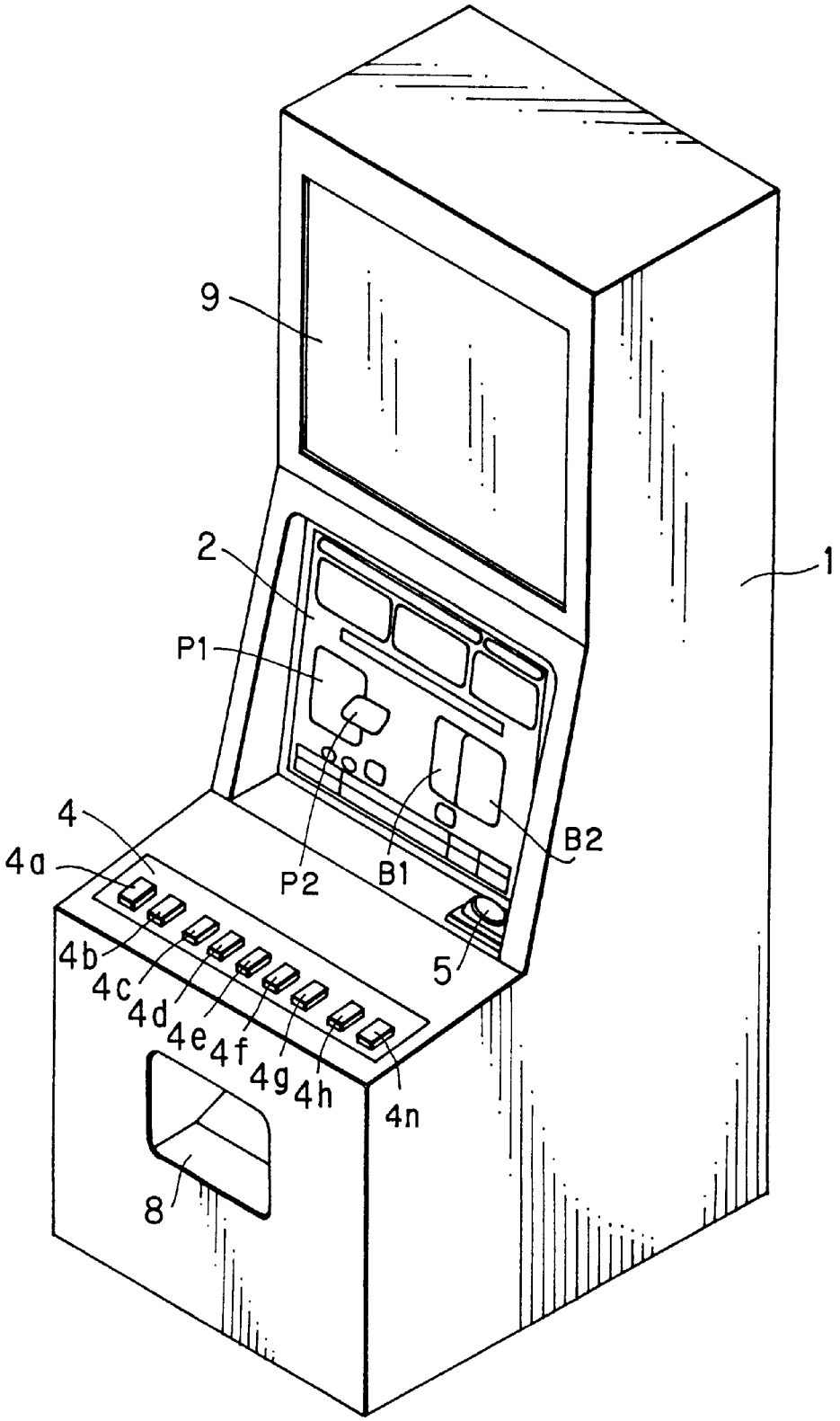
FIG. 1 is a perspective view showing the outer appearance of a video card game machine of the invention.

Referring to FIG. 1, a game machine 1 has a display 2 for displaying a baccarat game, an operation panel 4, a coin inlet 5 a decorative panel 9, and a coin outlet 8. The display 2 may be one of a CRT, a liquid crystal display, a plasma display, a projector, and the like. The operation panel 4 has a plurality of push switches 4*a* to 4*n*. Coins (inclusive of tokens and game chips) are inserted into the coin inlet 5 before starting a game. A predetermined number of credited coins are paid from the coin outlet 8. Printed on the decorative panel 9 are a trademark, a decorative picture, a brief description of a card game, and the like. The game machine 1 also has various electric circuits including a computer and mechanical units.

Figure 2:
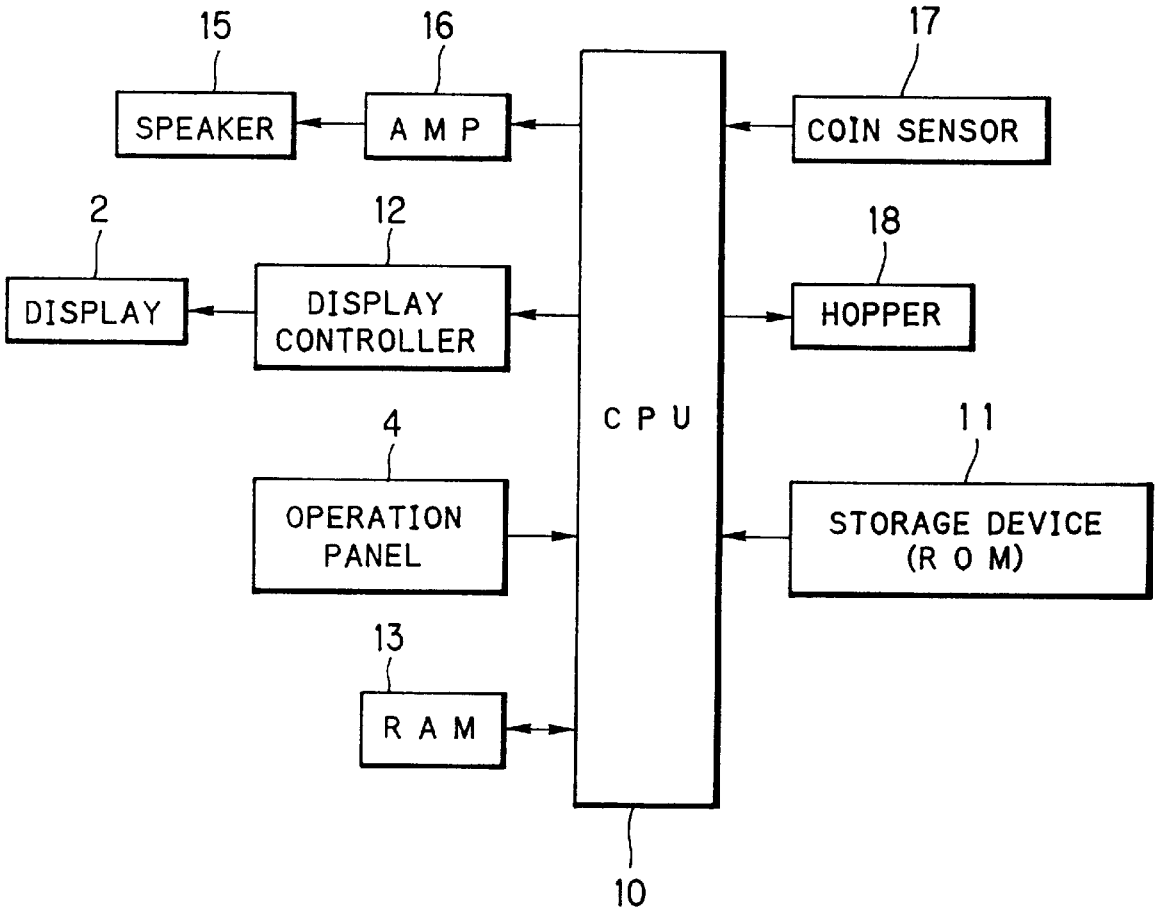
FIG. 2 is as block diagram showing an electrical structure of the video card game machine.

Referring to FIG. 2, connected to a central processing unit (CPU) 10 are the operation panel 4, a storage device 11, a display controller 12, a RAM 13, an amplifier 16, a coin sensor 17, and a hopper 18. The central processing unit 10 controls the display of an image (characters, numbers, symbols) on the display 2, to guide a game with recorded voices, and to operate each unit.

The storage device 11 is constituted of a ROM, a hard disk, or the like, and stores various programs for playing a baccarat game, symbol patterns of each playing card, and the like. The display controller 12 is constituted of a display control unit and an image memory for storing image data. This display control unit controls the reading of image data from an image memory and sends them to the display 2 or to write image data in the image memory in a designated area.

RAM 13 is used for storing data input from the operation panel 4, data of a score list indicating the contents of played games, the number of credited coins, and the like. The amplifier 16 drives a speaker 15 for generating message voices such as game progress guidance, game result conditions, and care progress state (game termination of the possibility of continuing a game). The coin sensor 17 detects a coin inserted into the coin inlet 5. The hopper 18 ejects credited coins.

Figure 3:
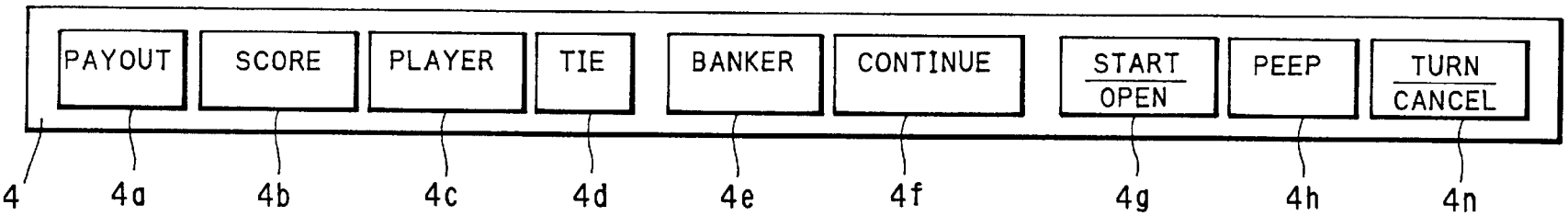
FIG. 3 is an illustrative diagram showing push switches on an operation panel.

As shown in FIG. 3, the operation panel 4 has nine push-type switches 4*a* to 4*n*. A payout switch 4*a* is operated when coins are to be paid out. The central processing unit 10 activates the hopper 18 to eject a predetermined number of coins via the coin outlet 8. A score switch can be operated only before a card game starts, and when it is operated, a score list indicating the contents of card games played up to date is displayed. This score list is used for reference when the card game is played.

A player switch 4*c* is used for selecting the player if the game player thinks that the player will win the card game. A tie switch 4*d* is operated if the game player thinks that the card game will be in a tie. A banker switch 40 is used for selecting the banker. These switches 4*c* to 4*e* are allowed to operate only before playing cards are distributed. When each of the switches 4*c* to 4*e* is pushed once, the game player makes one bet. When it is pushed twice, the game player makes two bets; and then it is pushed N times, the game player makes N bets. In this embodiment, one bet corresponds to one coin. If there are two denominations of usable coins, one bet corresponds to one coin of the smaller denomination. A continue switch 4*f* is operated once if the same amount of coins as the previous one is bet. When the continue switch 4*f* is operated four times, N times the previous amount is bet.

A start/open switch 4*g* performs two functions. One is to start distribution of playing cards, and the other is to open (turn the playing card face-up) one turned-down judgment playing card. If the start/open switch 4*g* is not depressed after a lapse of a predetermined time after playing cards are distributed, the judgment playing card is automatically opened.

Four playing cards are sequentially distributed alternately to the banker and player, two playing cards for each competitor. At least one of the playing cards distributed is a judgment card turned down which determines, when it is faced, a win, loss, or tie, and a card game progress state (termination or continuation).

If the game results cannot be determined from the playing cards distributed to the two competitors, that is from two playing cards for each competitor, according to the card rules, this card game continues further and third playing card is distributed to one or both of the two competitors. If the third card is distributed to one of the competitors, this third card becomes the judgment card, whereas if the third card is distributed to both the competitors, one of the third cards become the judgment card. As above, if the card game continues further, the two judgment cards in total are distributed during one card game.

In this embodiment, the second playing card distributed to the competitor on which the game player bets coins becomes the judgment card. Alternatively, the first distributed playing card or the two distributed playing cards may be used as the judgment card. In the latter case, the sum of the numbers of two playing cards is used for indicating the game conditions and the game progress state.

Irrespective of a bet made by the game player, the judgment card may be given to one of the competitors, e.g., the banker, or the judgment card may be given alternately to the two competitors for respective card games.

A peep switch 4*h* is used for peeping at the face of the judgment card and is allowed to operate until the judgment card is faced. While the peep switch 4*h* is depressed, the state shown in FIG. 9A changes to the state shown in FIG. 9B in which the one end portion of the playing card is faced.

Figure 10:
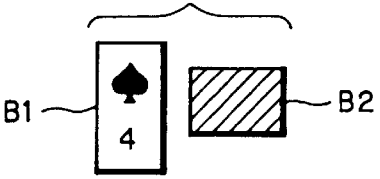
FIG. 10 is an illustrative diagram showing a turned-down playing card.

A turn/cancel switch 4*n* is used for cancelling a bet is operated before playing cards are distributed, or is used for rotating the judgment card by 90 degrees as shown in FIG. 10 if it is operated after playing cards are distributed and before the judgment card is faced.

In baccarat, a competitor having the sum of numbers of two or three playing cards nearer to "9" is a winner, and if the two competitors have the same number, the card game is a tie. IF the sum of numbers of playing cards is two digits, the number of the lower digit is used as the sum. For example, if the sum is "13 ", "3" is used as the sum. "10", "J", "Q", and "K" are used as "10", and "A" is used as "1".

Basically, the game results of baccarat are determined from the sum of numbers of two playing cards. However, depending upon the sum of numbers of the two playing cards, the third playing card may be required to be drawn or not to be drawn. Whether or not the third playing card is drawn depends upon complicated card rules specific to baccarat. Table 1 shows player card rules, and Table 2 shows banker card rules.

TABLE 1

| Sum af two playing cards of player | Third playing card of player |
|---|---|
| 0, 1, 2, 3, 4, 5 | drawable if banker is not natural |
| 6, 7 | not drawable (stand) |
| 8, 9 | both competitors not drawable (natural) |

TABLE 2

| Sum of two playing cards of | Number of third playing card of player | |
|---|---|---|
| banker | banker must draw | banker cannot draw |
| 3 | 0, 1, 2, 3, 4, 5, 6, 7, 9 | 8 |
| 4 | 2, 3, 4, 5, 6, 7 | 0, 1, 8, 9 |
| 5 | 4, 5, 6, 7 | 0, 1, 2, 3, 8, 9 |
| 6 | 6, 7 | 0, 1, 2, 3, 4, 5, 8, 9 |
| 7 | Not drawable (stand) | |
| 8, 9 | both competitors not drawable (natural) | |
| 0, 1, 2 | must draw | |

Referring to Table 1, if the sum of two playing cards of the player is "6" or "7", the third playing card cannot be drawn. This state is called a "stand". The sum "8" or "9" is called a "natural", and both the competitors cannot draw the third playing card. This state of not being able to draw is called a "natural stand". For the banker, the sum "7" is a "stand", and the sum "8" or "9" is a "natural". The sum "0" is called a "baccarat". If both the competitors have the same sum "6", the game is terminated as a tie game.

The game results include a win, a loss, and a tie so that the game results include wins, losses, and ties. In baccarat, if the game becomes a tie, coins bet on an expected winner competitor are refunded. Therefore, from the viewpoint of a game player, a win and a tie may be considered as one group and a loss is considered as the other group. In the following description, in order to make the term easy to understand, a term "win/tie conditions" is used instead of the term "game conditions".

In this embodiment, if the same player bets coins on an expected winner competitor, the win and tie conditions are displayed on the display 2 before the playing card is faced. If the game player bets coins on a tie game, only the tie conditions are displayed on the display 2.

Figure 4:
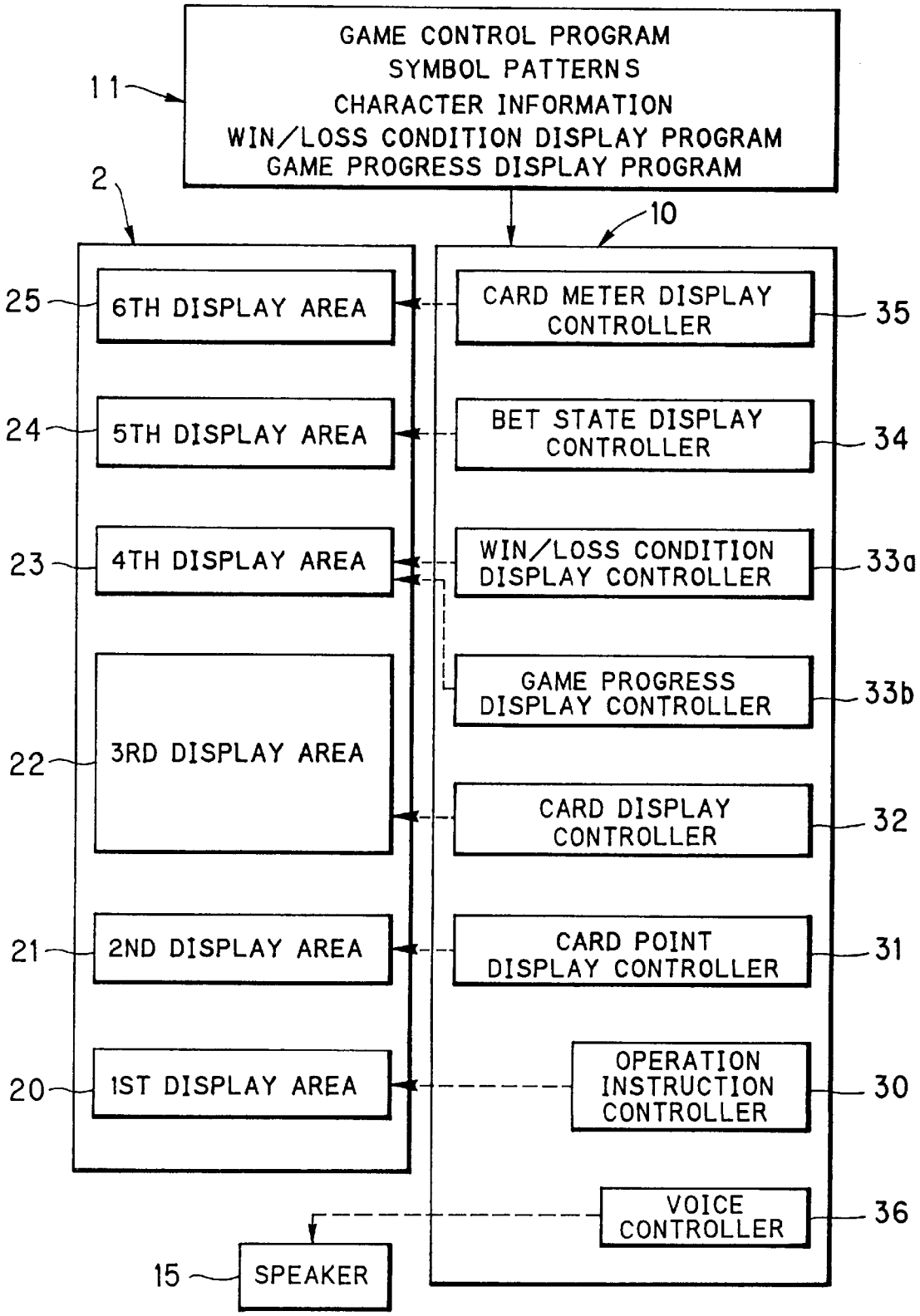
FIG. 4 is an illustrative diagram showing functions of a central processing unit and a relationship among display areas.

Referring to FIG. 4, the storage device 11 stores a game control program for the execution of card games, symbol patterns of playing cards, character information, a win/tie condition display program, a game progress display program, and the like. The win/tie condition display program is used for the display of whether the game on which the game player bet becomes a win or a tie. If the game player bets on a tie game, this program displays only the tie conditions.

According to the card rules described above, the card game terminates with the dealing of either two or three playing cards. Since these card rules are difficult, the game progress state display program displays a termination of a card game, i.e., a completion of playing card distribution. If the card game does not terminate, a playing card is further drawn to continue the card game. Therefore, if a termination of a card game is not displayed, it means a continuation of the card game.

Figure 6:
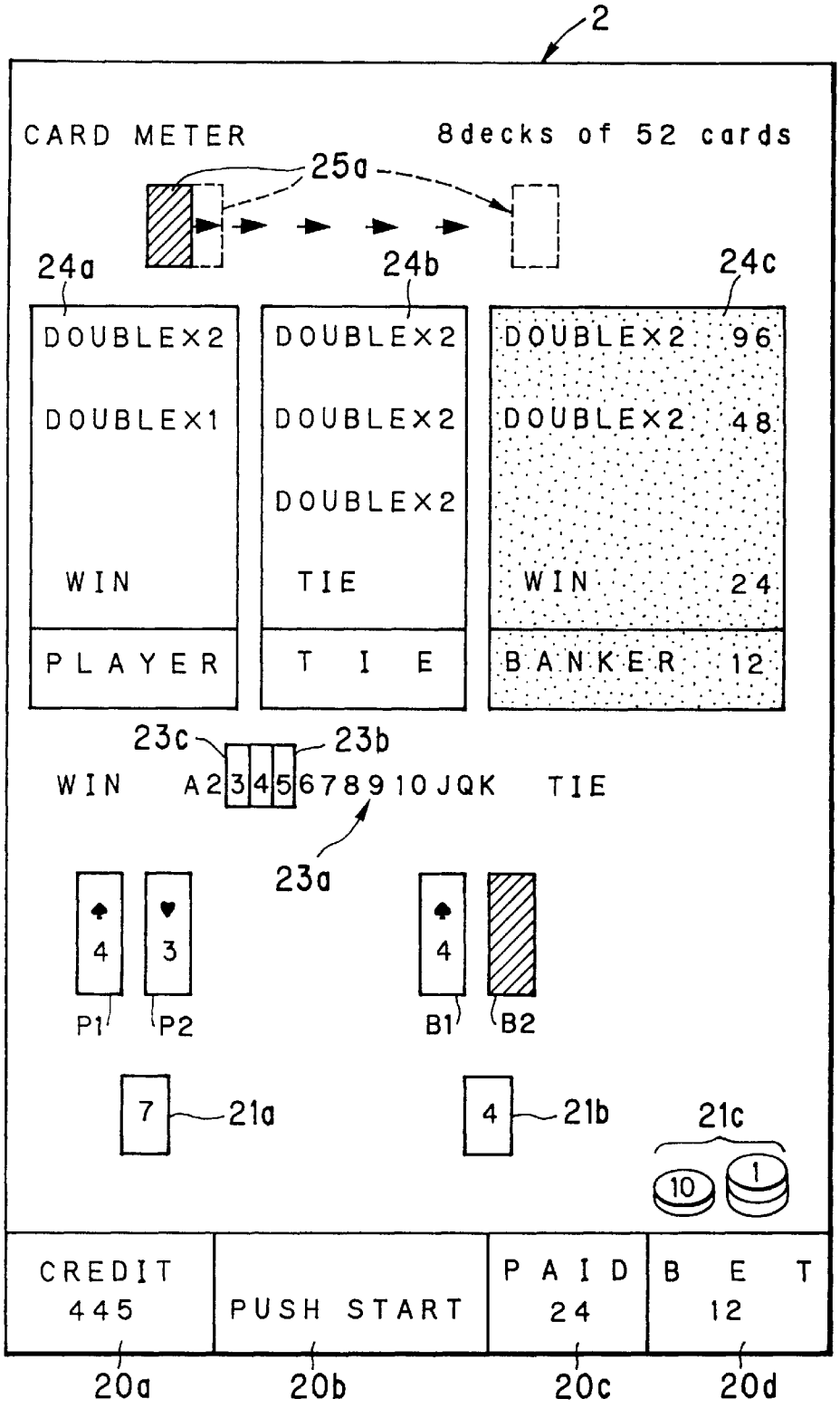
FIG. 6 is an illustrative diagram of a display screen showing four distributed playing cards.

The screen of the display 2 is divided into a plurality of areas in each of which predetermined information, symbols, and the like are displayed. An example of the display contents in each display area is shown in FIG. 6. Displayed in a first display area 20 are the number 20*a* of credited coins, a message 20*b* urging the operation of a push button, the number 20*c* of coins gained by the present card game, and the number 20*d* of coins bet by the game player.

Displayed in a second display area 21 are the sum 21*a* of the number of two or three playing cards distributed to the player, the sum 21*b* of numbers of two or three playing cards distributed to the banker, and a symbolic representation 21*c* of the number of bet coins.

Displayed in a third display area 22 are two or three playing cards P1 to P3 distributed to the player and two or three playing cards B1 to B3 distributed to the banker.

Displayed in a fourth display area 23 are a series 23*a* of numbers of playing cards, the words "WIN" and "TIE", the win/tie conditions, and the game progress state. The word "WIN" is displayed in red, and the word "TIE" is displayed in blue. The number series 23*a* is "A, 2 to 9, 10, J, Q, K". The number "A" is "1", and the numbers "10, J, Q, and K" are each "10". Instead of the number series "A, 2 to 9, 10, J, Q, K", a number series "1, 2, 3, 4, 5, 6, 7, 8, 9, 0" may be displayed.

The win/tie conditions are displayed at the same time, or immediately after, the judgment card is distributed, by surrounding particular numbers with frames. These particular numbers are numbers of the judgment card which indicate that the competitor whom the game player bets on is in a win or tie. In this example, the number indicating a win is surrounded with a red frame and the number indicating a tie is surrounded with a blue frame. These frames are displayed continuously or flashed to indicate the game progress state.

The red frame continuous display indicates that if the judgment card has the number surrounded by this frame, the competitor whom the game player bet on has won, and also indicates that if the judgment card has the other number, the third card is drawn. Specifically, the red frame continuous display shows the possibility of continuing the card game and also shows win condition information. The red frame flashing display shows the win condition information and card game termination.

The blue frame continuous display indicates a tie if the judgment card has the number surrounded by this frame, and also indicates continuation of the card game if the judgment card has the other number. The blue frame flashing display indicates a tie game condition and termination or the card game. The number indicating a loss may be surrounded with a frame instead of surrounding the number indicating a win or tie.

Instead of using a frame, the color of a number may be changed, a number may be covered with meshed dots, formed by a dot pattern, with a line added, or they may be flashed, enlarged, or swayed. If the win/tie conditions and game progress state are to be displayed at the same time, different display methods are used respectively.

Instead of using the number series, only numbers indicating a win or tie, or a loss may be displayed. In this case, the game progress state is displayed by changing the display method of the numbers. For example, a capability of continuing the card game may be indicated by a continuous display of a number and a termination of the card game is indicated by a flashed number, or the game progress state may be indicated by changing the colors of the numbers.

If the game progress state and win/tie conditions are displayed at the same time, the screen of the display 2 can be utilized efficiently. These may be displayed independently. For example, the messages "game termination", "capability of card draw", and the like may be displayed on the display 2 to inform the same player of the game progress state.

A fifth display area 24 is divided into a player area 24*a*, a tie area 24*b*, and a banker area 24*c*, each being rectangular. In each rectangular area, large characters "DOUBLE× number", "number", "WIN", "PLAYER", "BANKER", and "TIE"are displayed. The rectangular area of the competitor whom the game player bet on is partially or totally changed in color. In the example shown in FIG. 6, the display of the banker rectangular area 24*c* is changed so that it is possible to know that the bet competitor is the banker. The bet competitor rectangular area may be flashed, enlarged, etc.

In a sixth display area 25, the number of remaining or used playing cards is shown. For example, in this sixth display area 25, the legends "CARD METER" at the left side and "8 decks of 52 cards" at the right side are displayed. The number 25*a* of remaining playing cards is shown by moving one playing card from the left to the right between the two legends. The inside of the rectangle may be colored to indicate the number of remaining or used playing cards.

Although the screen of the display 2 is divided into six display areas, the number of these areas may be increased or decreased if necessary. For example, the six display area indicating the card meter may be omitted. The position of each display area may be changed as desired.

The central processing unit 10 executes various types of data processing by using fixed data stored in the storage device 11 and variable data stored in RAM 13, in accordance with various programs stored in the storage device 11. The data processing includes, for example, generation of image data to be displayed on the display, voice guidance data, and the like. FIG. 4 shows the central processing unit 10 in the form of blocks of data generation control functions. The central processing unit 10 has an operation instruction controller 30, a card point (sum) display controller 31, a card display controller 32, a win tie condition display controller 33*a*, a game progress display controller 33*b*, a bet state display controller 34, a card meter display controller 35, and a voice controller 36.

The operation instruction controller 30 generates image data to be displayed in the first display area 20. The card point display controller 31 generates image data to be displayed in the second display area 21. The card display controller 32 generates image data to be displayed in the third display area 22. The win/tie condition display controller 33*a* generates image data of the win and tie conditions to be displayed in the fourth display area 23. The game progress state display controller 33*b* generates display area 24 changes. The example shown in FIG. 6 indicates that the game player depressed the banker switch 4*e* twelve times and bet "12" coins on the banker. This number of bets "12" indicates that 12 coins of the smallest denomination were bet.

As the game player hearing announcements from the speaker 15 depresses the start/open switch 4*g*, distribution of playing cards is displayed on the display 2 in simulation. If the start/open switch 4*g* is not depressed after a lapse of a predetermined time, distribution of playing cards automatically starts.

The first playing card P1 is distributed to the player in the third display area 22 face up. The next playing card is distributed as the first playing card B1 face up. The numbers of the playing cards P1 and B1 are displayed in the left and right rectangles 21*a* and 21*b* in the second display area 21. Next, the second playing card P2 is distributed to the player face up. In this example shown in FIG. 6, the sum of numbers of the playing cards P1 and P2 of the player is "7" which is displayed in the rectangle 21*a*. Lastly, the second playing card B2 is distributed to the banker as the judgment card, faced down.

If the sum of numbers of the two playing cards P1 and P2 of the player is "8" or "9", the game is a "natural". In this case, according to the card rules shown in Table 1, neither of the competitors draw a third card. The number leading to a win of the banker whom the game player bet on is displayed in the flashing red frame. The number leading to a tie of the card game is displayed in the flashing blue frame. Namely, the numbers necessary for a win or tie are displayed and a termination of playing card distribution is indicated.

If the sum of numbers of the two playing cards P1 and P2 of the player is one of "0 to 5", the third playing card is given to the player. If the sum of the player is "6" or "7", the player becomes a "stand" and the third playing card may be given or not given to the banker. If the sum of the player is one of "0 to 7", the number necessary for the banker to win is displayed in the continuous red frame 23*b*, whereas the number necessary for a tie is displayed in the continuous blue frame 23*c*.

In the example shown in FIG. 6, since the sum of the player's card is "7" and the first playing card B1 of the banker is "4", the number "3" is displayed in the continuous red frame 23*c* and the numbers "4 and 5" are displayed in the continuous red frame 23*b*. Namely, the numbers necessary for a win or tie are displayed the possibility and of continuing playing card distribution is indicated. At the same time, a message "win conditions are "4" and "5"" is announced from the speaker 15. If the game player bet on a tie, only the blue frame 23*c* is displayed.

Figure 9A:
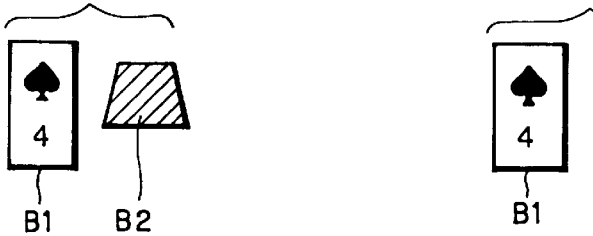
FIG. 9A is an illustrative diagram showing two distributed playing cards.
Figure 9B:
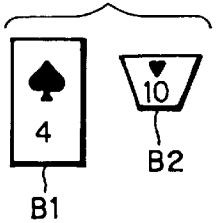
FIG. 9B is an illustrative diagram showing a peep state.

If second playing card B2 is to be peeped, the switch 4*h* is depressed. When this peep switch 4*h* is depressed, the second playing card B2 is slightly turned up as shown in FIG. 9B. If the turn/cancel switch 4*h* is depressed, the playing card B2 is rotated by 90 degrees as shown in FIG. 9A. If the peep switch 4*h* is depressed in this state, the playing card B2 is laterally turned up.

If the start/open switch 4*g* is depressed after the fourth playing cards are distributed, the second playing card B2 of the banker is faced. If the start/open switch 4*g* is not operated after a predetermined time lapse after distribution of the four playing cards, the playing card B2 is automatically faced.

The game is judged after the second playing card B2 of the banker is faced. If the number of the second playing card B2 is "4" or "5", the banker becomes a "natural". As seen from Tables 1 and 2, if one of the two competitors is a "natural", neither cf the competitors can draw the third playing card and the game is terminated. In this case, the winner is the banker because the player has a sum "7" of the two playing cards and the banker has a sum of "8" or "9". A message such as "the banker is a winner and the card game is terminated" is announced from the speaker 15. The number "24" of gained coins is accumulated by a credit counter and "469" is displayed on the credit field 20*a*. During a game progress, the image of one playing card 25*a* is moved little by little from a predetermined initial position to the right.

Even if one of the two competitors does not become a "natural", if both of them having a sum "6", then the game is a tie and it is terminated. If the player is "6" and the banker is "7" or both the competitors are "7", the game is judged and terminated. In these cases, if the competitor whom the game player bet on becomes a winner, a predetermined amount of dividend is paid out, and if the game is a tie, the amount of bet coins is credited.

If one of the two competitors is not a "natural", if both the competitors are not a "stand", or if both the competitors are not "6", the card game continues. The following four patterns can exist when the card game continues.

In the first pattern, the player is a "stand" and the banker is not a "stand". In this pattern, the third playing card B3 is distributed in a turned-down state only to the banker as the judgment card.

In the second pattern, the player is not a "stand" and the banker is a "stand". In this pattern, the third playing card P3 is distributed in a turned-down state only to the player as the judgment card. This second pattern is omitted in FIG. 5B.

In the third pattern, the player is not a "stand" and the banker is one of "0 to 2". In this pattern, the third playing cards P3 and B3 are distributed to both the competitors, respectively. In this case, first the third playing card P3 is distributed face up to the player, and then the third playing card B3 is distributed face down to the banker.

In the fourth pattern, the player is not a "stand" and the banker is one of "3 to 6". In this pattern, the third playing card P3 is distributed in the face-down state to the player. Also in this case, depending upon the number of the third playing card P3, the banker either cannot draw the third playing card B3 or is required to draw it.

In the first to third patterns, the game is judged when the third playing card P3 or B3 is faced. In these patterns, since there is no capability of continuing the card game, the win/tie conditions are displayed by the red and blue flashing frames. As described earlier, after the judgment card is faced, the game is judged and any dividend is paid out.

Figure 7:
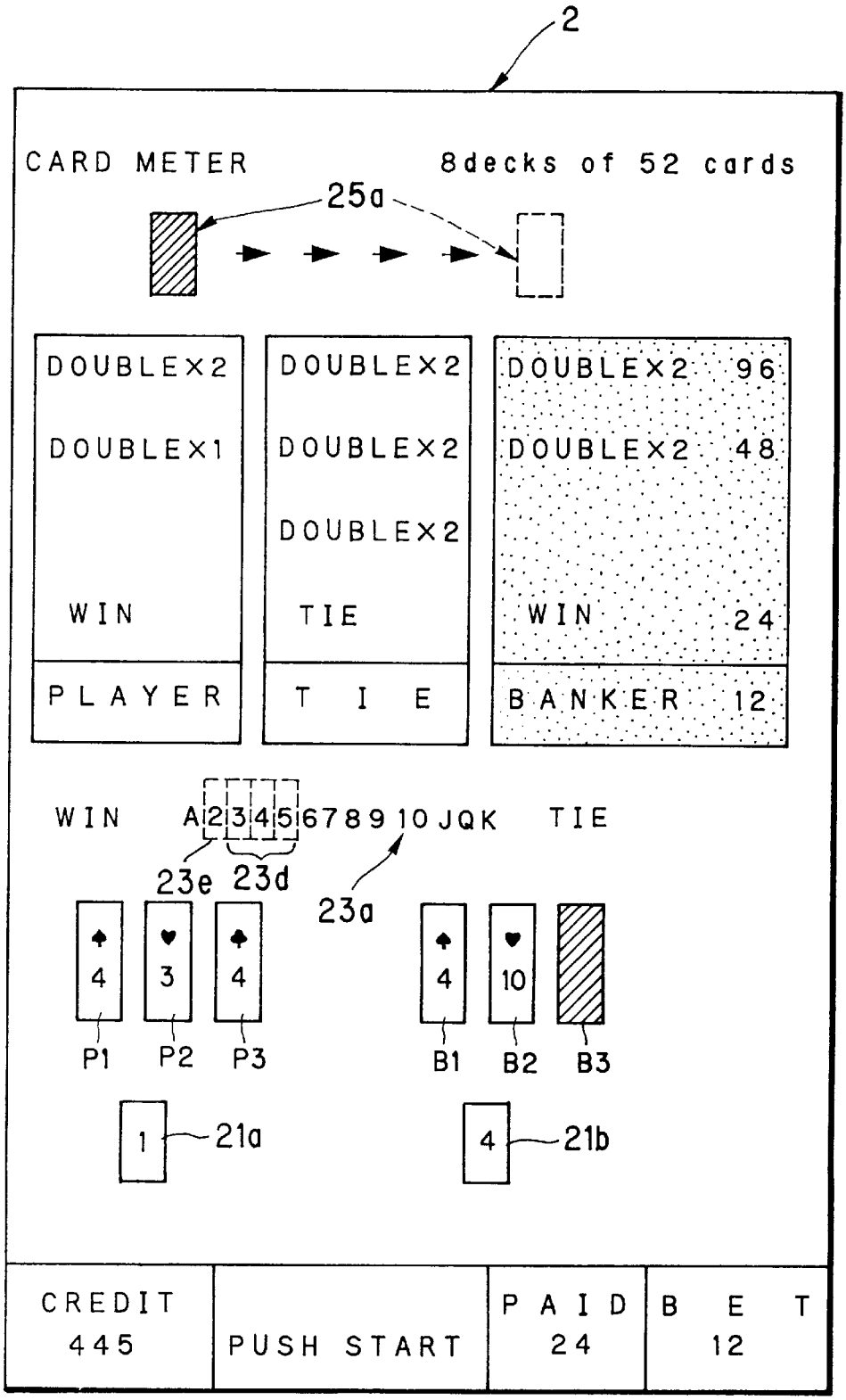
FIG. 7 is an illustrative diagram of a display screen showing six distributed playing cards.

In the fourth pattern, the third playing card P3 is distributed face down to the player as the judgment card. In this pattern, since there is a capability of continuing the card game, the win/tie conditions are displayed by the red and blue frames. If the condition that the banker cannot draw the third playing card B3 is satisfied when the third playing card P3 is faced, the game is judged and divided is paid out. On the other hand, if the condition that the banker is required to draw the third playing card B3 is satisfied, this card B3 is distributed face down as the judgment card as shown in FIG. 7. In this case, the win/tie conditions are displayed by the red and blue flashing frames. After this third playing card B3 is faced, the game is judged and a dividend is paid out.

In the above manner, the game player can enjoy a simulated baccarat game. If the game player wants to finish the game, the payout switch 4*a* is depressed to receive the credited coins from the coin outlet 8.

Figure 5A:
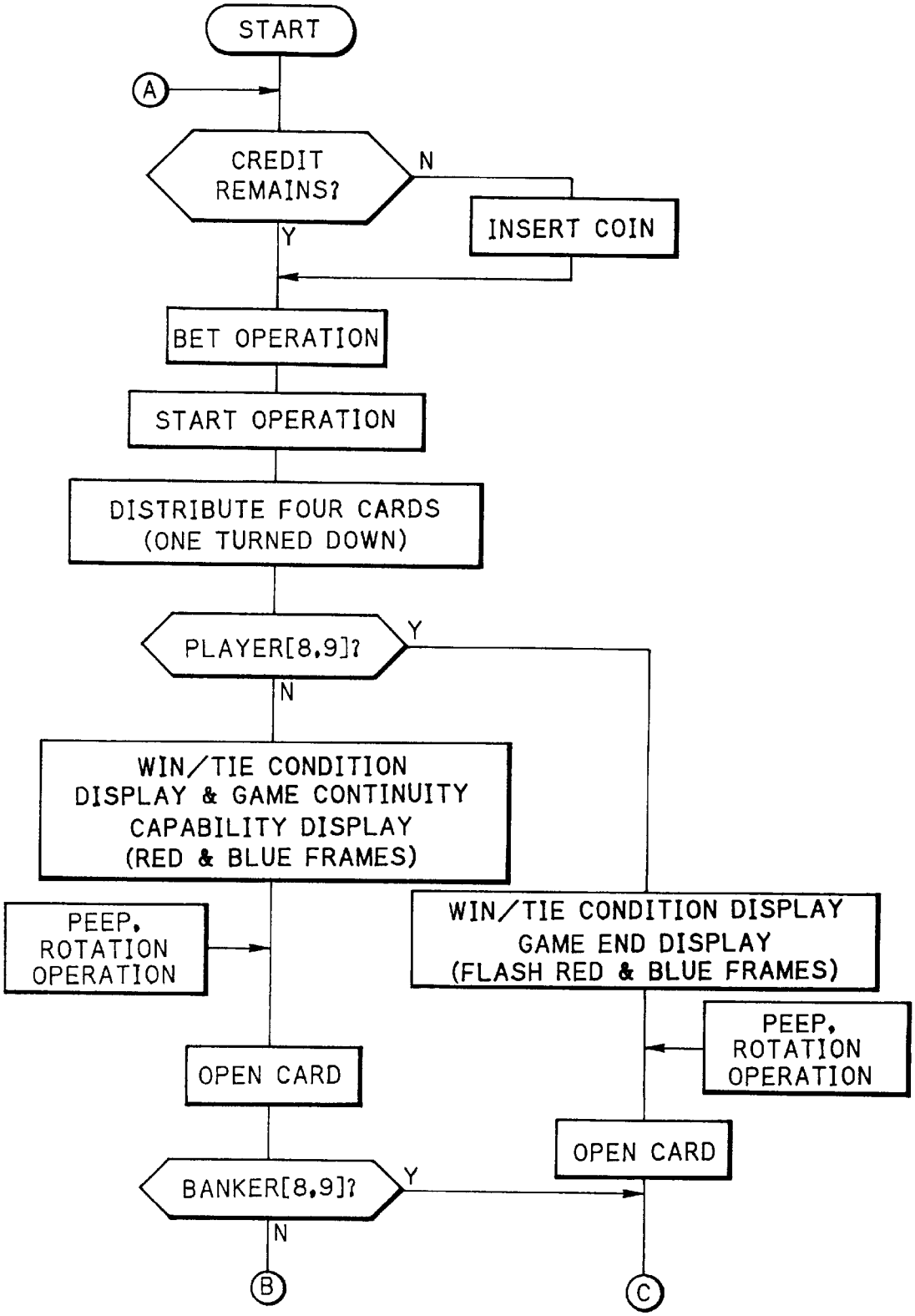
FIGS. 5A and 5B are flow charts illustrating the processes of a card game.
Figure 5B:
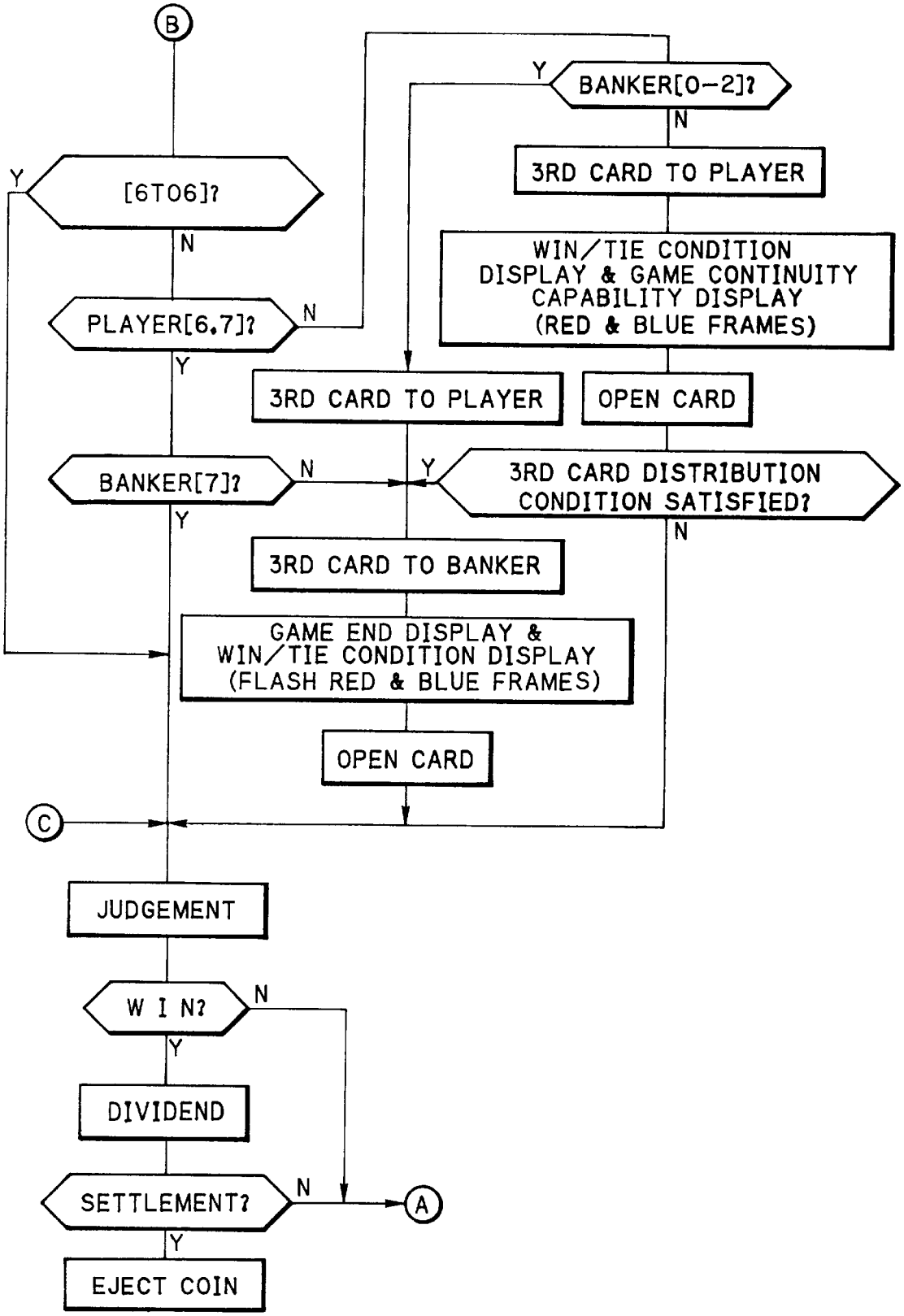

FIGS. 5A and 5B are flow charts illustrating a baccarat game in which the game player bets on the banker. If the game player bets on a tie, only the tie conditions are displayed by a continuous blue frame or a flashing blue frame. If the game player bets on the player, "player [8, 9]?" in FIG. 5A is changed to "banker [8, 9]?". In this case, two playing cards are distributed to the banker and the playing card P2 of the player becomes the judgment card. In the third pattern, the third playing card P3 of the player becomes the judgment card.

Figure 8:
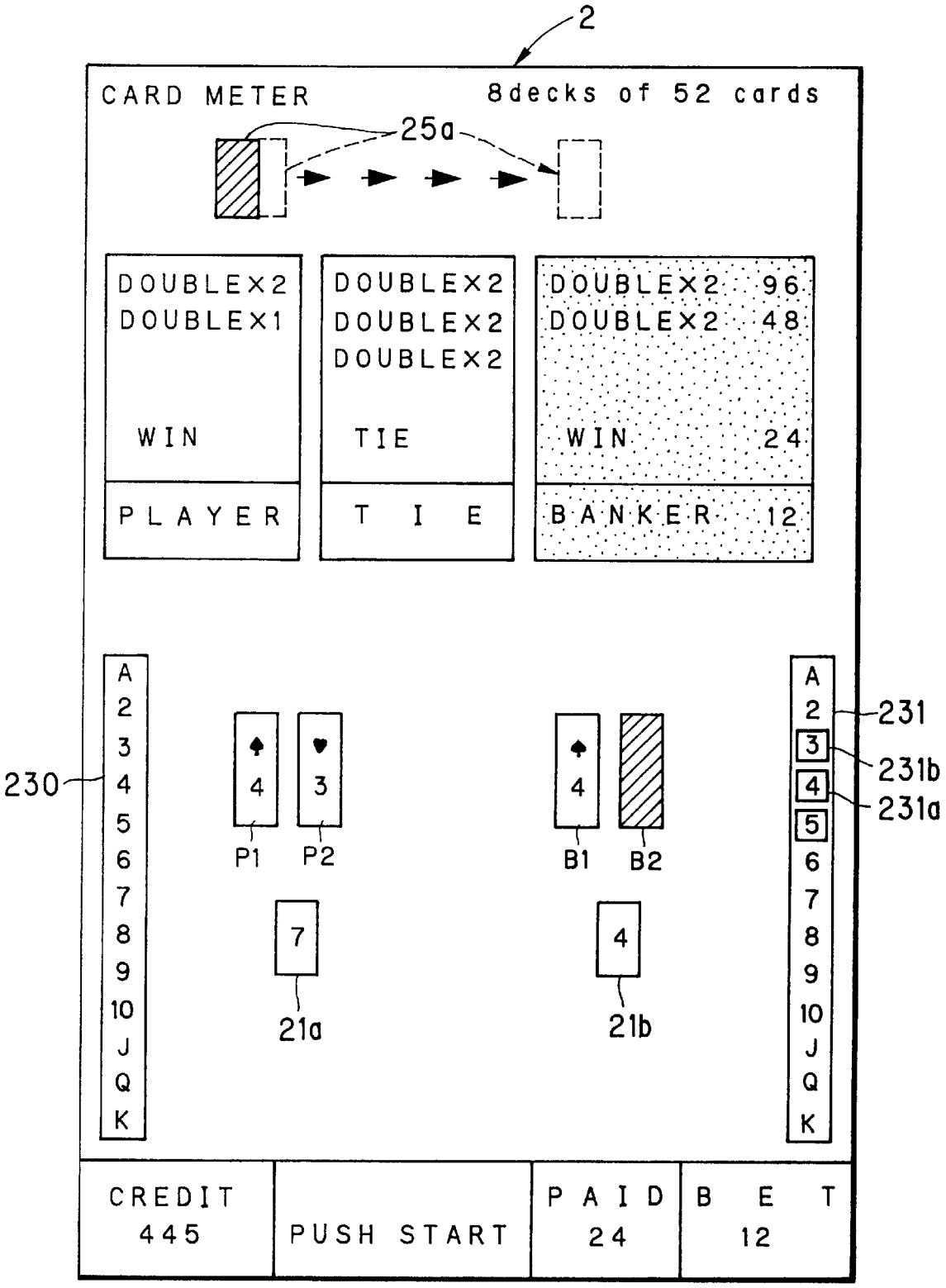
FIG. 8 is an illustrative diagram of a display screen showing another example of display contents.

FIG. 8 shows another embodiment in which number series are provided separately for the player and banker. A number series 230 for the player is vertically displayed on the left side of playing cards P1 to P3 of the player, and a number series 231 for the banker is vertically displayed on the right side of playing cards B1 to B3 of the banker. In this example, since the game player bet on the banker, the number in the banker number series 231 necessary for a win is displayed in a red frame 231*a*, and the number necessary for a tie is displayed in a blue frame 231*b*. Such two-number series help a beginner understand the bet state, win/tie, and game progress state.

Figure 11:
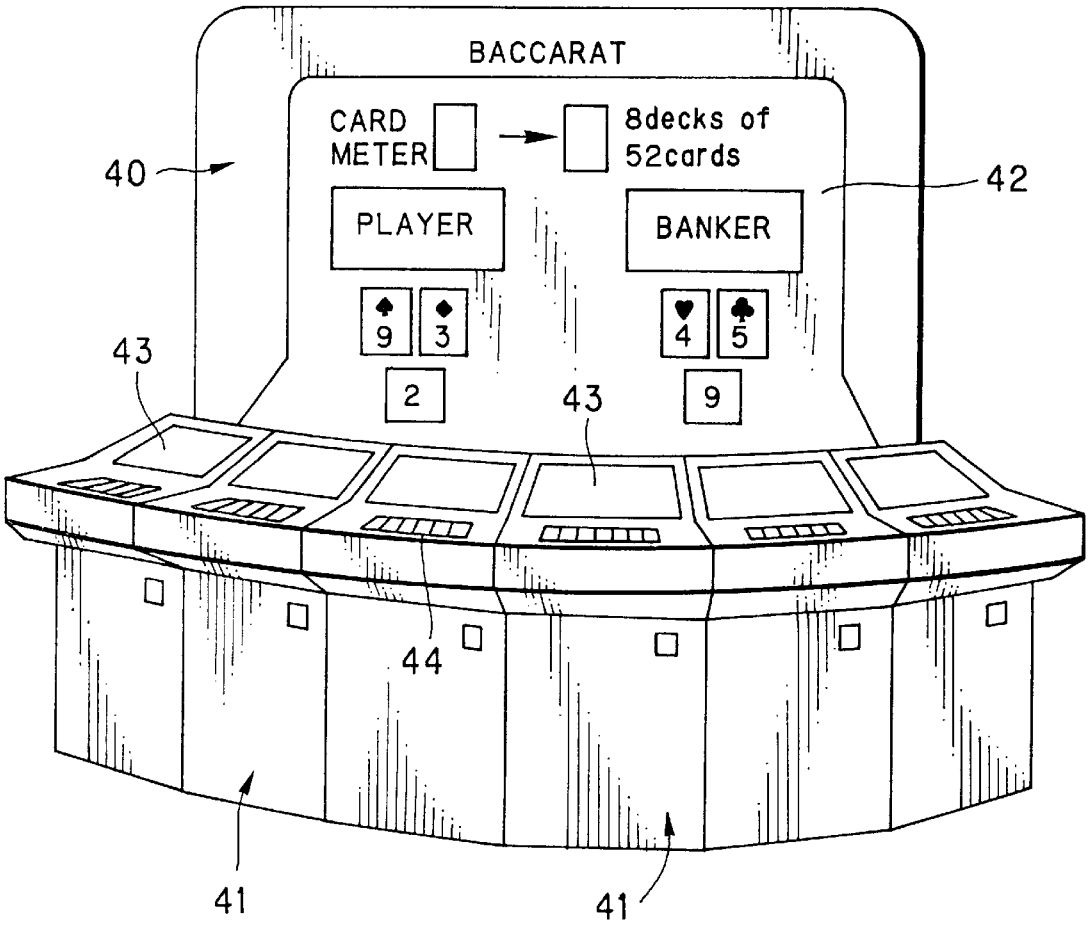
FIG. 11 is a perspective view of a video card game machine usable by a plurality of card game players.

FIG. 11 shows a video card game machine capable of being used by a plurality of game players at the same time. This video game machine has a main game machine and satellites, e.g., six satellites. The main game machine 40 has a server computer which is connected to a computer of each satellite 41. The main game machine 40 has a large monitor 42 on which information common for all game players is displayed, such as distributed playing cards, a sum of numbers of playing cards, and a card meter.

Each satellite 41 has its own computer and a small monitor 43 on which information specific to each game player is displayed, such as bet state, number series, win/tie information, game progress state information, and the number of credited coins. Each satellite 41 has an operation panel 44 for entering bets. This operation panel 44 has switches like those shown in FIG. 3, such as a payout switch, a score switch, a player switch, a tie switch, a banker switch, a continue switch, a peep switch, and a turn/cancel switch.

With a card game machine for a single game player, the second or third playing card is distributed in the face-down state to the competitor whom the game player bet on. However, with a card game machine for a plurality of game players, both the player and banker are generally bet by the game players. From this reason, the second or third playing card is distributed always in the face-down state to a predetermined competitor.

A peep is given as a privilege only to the game player who bet the largest number of bets on the banker or player. The game player given the peep privilege can peep the judgment card on this or her small monitor by activating the peep switch. The other game players cannot peep the judgment card even if their peep switch is operated.

In accordance with a voice message from the main game machine 10 and a display on the small display at each satellite, coins are inserted to be on the card game. Each bet state is displayed on the small monitor at each satellite 41. The total of bets is displayed on the large monitor 42 independently for the banker and player.

As a predetermined time lapses, playing cards are distributed. After this playing card distribution, the win/tie conditions and game progress state for each game player are displayed on the small monitor. Award of the peep privilege is informed by a voice message or by a display on the large monitor 42.

After a lapse of a predetermined time, the judgment card is faced to judge the card game. If a judgment cannot be made by the second playing card, the third playing card is distributed according to the card rules. At the same time, the win/tie conditions are displayed n the small monitor 43. The game is judged by opening the third playing card. If the game player hits, a predetermined number of coins are credited to the game player.

In the above embodiments, the win/tie conditions are displayed in the red and blue frames, and the game progress state is displayed in the continuous and flashing frames. This may be reversed. Although two types of information are displayed, one type only may be displayed. For example, only the win/tie conditions may be displayed, or conversely only the game progress state may be displayed. The win/tie conditions and game progress state may be displayed while a message regarding the game progress is given the speaker 15.

If the sum of numbers of playing cards of the player is "2" or "3" and that of the banker is "1" or "2", the third playing card is distributed to the player as the judgment card according to the game rules. If this third playing card is "8", the banker cannot draw the third playing card and the game is terminated at this point. Alternatively, the third playing card maybe distributed in the face-down state to the player and the number "8" in the number series is flashed or the color of the number is changed to display the game termination conditions. If the sum of two playing cards of the banker is "5" and the third playing card distributed to the player is one of "1, 2, 3, 8, 9, 10, J, Q, and K", the banker cannot draw the third playing card and the game is terminated at this point. In this case, the game termination conditions may be displayed by selectively displaying only the above numbers. In the manner described above, only the game termination conditions may be displayed or only the numbers indicating the win/tie conditions may be displayed without using the number series.

In the above embodiments, the number series of playing cards and the words regarding the win/tie "WIN, TIE" are displayed in the fourth display area 23. These words regarding the win/tie may be omitted. In the embodiment shown in FIG. 6, one number series is displayed. Two lateral number series for the banker and player may be displayed.

The invention is applicable not only to video card game machines for business use installed at casinos or game centers but also to computer game machines for home use. The invention is also applicable to a card game to abe played with a personal computer for home use.

Various modifications and changes of the invention are possible which should be construed as falling in the protective scope of this invention.

What is claimed is:

1. A machine for playing baccarat, comprising:

a central processing unit embodying a baccarat game control program;

a display responsive to said central processing unit for displaying two sets of from two to three playing cards and, for each of said two sets, a total value of the displayed cards that are face up, while a baccarat game is being played, where one of said displayed cards is a judgment card displayed face down, said display means also for displaying a row of at least ten alphanumeric identifiers that are one of playing cards and playing card values; and display control means for displaying on said display a potential win of the baccarat game being played by displaying at least one first identifier of said row of identifiers in one of a first color and a frame of the first color to distinguish said first identifier from a remainder of said identifiers in said row, said first identifier would, if said first identifier has a value that matches a value of the judgment card when the judgment card is turned face up, cause the first color to flash indicating that the baccarat game being played has been won and is terminated, and for displaying on said display a potential tie of the baccarat game being played by displaying at least one second identifier of said row of identifiers in one of a second color and a frame of the second color, the second color being different from the first color to distinguish said second identifier from said first identifier and from a remainder of said identifiers, said second identifier world, if said second identifier has a value that matches a value of the judgment card when the judgment card is turned face up, cause the second color to flash indicating that the baccarat game being played has been tied and is terminated.

2. The machine of claim 1, wherein said identifiers are cards ace through king.

3. The machine of claim 1, wherein said first and second identifiers are surrounded by respective frames of the first and second colors.

4. The machine of claim 1, wherein said first and second identifiers take the respective first and second colors.

* * * * *